United States Patent [19]

Milberger et al.

[11] 4,280,531

[45] Jul. 28, 1981

[54] METHOD AND APPARATUS FOR HYDRAULICALLY CONTROLLING SUBSEA WELL EQUIPMENT

[75] Inventors: Lionel J. Milberger; Albert R. Tucker, both of Spring, Tex.

[73] Assignee: FMC Corporation, San Jose, Calif.

[21] Appl. No.: 149,408

[22] Filed: May 13, 1980

Related U.S. Application Data

[62] Division of Ser. No. 23,933, Mar. 26, 1979, which is a division of Ser. No. 873,323, Jan. 30, 1978, Pat. No. 4,185,541.

[30] Foreign Application Priority Data

Feb. 26, 1977 [GB] United Kingdom ..... 8216/77

[51] Int. Cl.[3] ..... F15B 18/00

[52] U.S. Cl. ..... 137/624.11; 91/526; 137/597; 137/596

[58] Field of Search ..... 137/625.11, 624.18, 137/624.2, 625.25, 596, 625.48, 597

[56] References Cited

U.S. PATENT DOCUMENTS

| | | | |
|---|---|---|---|
| 2,788,408 | 4/1957 | Chevey | 137/625.11 X |
| 2,827,924 | 3/1958 | Towler | 137/625.46 X |
| 3,040,777 | 6/1962 | Carson | 137/625.46 X |
| 3,074,431 | 1/1963 | Schwartz | 137/625.11 |
| 3,460,574 | 8/1969 | Risher | 137/625.21 X |
| 3,687,163 | 8/1972 | Nickels | 137/625.11 |
| 3,713,462 | 1/1973 | Busbee | 137/125.21 |
| 3,952,763 | 4/1976 | Bough | 137/625.11 X |
| 3,993,100 | 11/1976 | Pollard | 137/637 X |

*Primary Examiner*—Alan Cohan

*Attorney, Agent, or Firm*—L. B. Guernsey; W. W. Ritt, Jr.

[57] ABSTRACT

Method and apparatus for hydraulically controlling subsea well equipment, such as valve operators, connectors, and other hydraulically actuated devices, with a significantly reduced number of hydraulic pressure source lines from the surface to the subsea location of said well equipment. The apparatus includes a multi-mode subsea switching valve having a plurality of module-like sections, each section having an inlet port, a vent port and a plurality of outlet ports. When installed, this valve preferably is located near the subsea well, and a source of hydraulic pressure and a plurality of hydraulic switches, all located on a surface vessel or other surface facility, are connected to the valve's inlet ports by means of a relatively small number of hydraulic pressure source lines. A relatively large number of hydraulic outlet lines interconnect the valve's outlet ports and the subsea well equipment so that in each of its functional modes the valve directs fluid pressure to a different set of subsea devices. The valve is switched from one mode to another by a pulse of hydraulic pressure exerted on an operator apparatus that is connected to the valve's flow control element, and these modes are changed in a manner such that the position of the valve's flow control element is always known.

17 Claims, 20 Drawing Figures

FIG. 3A

P = PRESSURE

B = BLEED

E = EITHER

| OPERATION | OPERATORS 26a | 26b | 26c | 26d | 26e | 26f | 26g | 26h | 26i | 26j | 26k | 26L | 26m | 26n | 26o | 26p | 26q | 26r | 26s | 26t | 26u | 26v | 26w | 26x | 26y | 26z | 27a | 27b |
|---|---|---|---|---|---|---|---|---|---|---|---|---|---|---|---|---|---|---|---|---|---|---|---|---|---|---|---|---|
| 1. RUN TREE | B | B | P | B | B | B | P | E | P | P | P | P | P | P | P | P | P | P | P | B | B | E | E | E | B | B | B | B |
| 2. CONNECT TREE | B | B | P | B | B | P | B | B | P | P | P | P | P | P | P | P | P | P | P | B | B | E | E | E | B | B | B | B |
| 3. TREE CONNECTOR TEST MODE | B | B | P | B | B | P | B | B | P | P | P | P | P | P | P | P | P | P | P | B | B | E | E | E | B | B | B | B |
| 4. PULL TUBING HANGER PLUGS | B | B | P | B | B | P | B | B | B | P | P | P | P | P | P | P | P | P | P | B | B | E | E | E | B | B | B | B |
| 5. TEST #1 SCSSV | B | B | P | P | B | P | B | B | B | P | P | E | P | P | E | P | P | E | P | B | B | E | E | E | B | B | B | B |
| 6. TEST #2 SCSSV | P | B | P | B | B | P | B | B | B | P | P | E | P | P | E | P | P | E | P | B | B | E | E | E | B | B | B | B |
| 7. TEST #1 LOWER MASTER | P | B | P | P | B | P | B | B | B | B | P | E | P | P | E | P | P | E | P | B | B | E | E | E | B | B | B | B |
| 8. TEST #1 UPPER MASTER | P | B | P | P | B | P | B | B | B | P | P | E | P | P | E | P | P | E | P | B | B | E | E | E | B | B | B | B |
| 9. TEST #1 SWAB | P | B | P | P | B | P | B | B | B | P | P | E | P | P | E | B | P | E | P | B | B | E | E | E | B | B | B | B |
| 10. TEST #2 LOWER MASTER | P | B | P | P | B | P | B | B | B | P | B | E | P | P | E | P | P | E | P | B | B | E | E | E | B | B | B | B |
| 11. TEST #2 UPPER MASTER | P | B | P | P | B | P | B | B | B | P | P | E | P | B | E | P | P | E | P | B | B | E | E | E | B | B | B | B |
| 12. TEST #2 SWAB | P | B | P | P | B | P | B | B | B | P | P | E | P | P | E | P | B | E | P | B | B | E | E | E | B | B | B | B |

FIG_3B

| | | | | | | | | | | | | | | | | | | | | | | | | | | | | |
|---|---|---|---|---|---|---|---|---|---|---|---|---|---|---|---|---|---|---|---|---|---|---|---|---|---|---|---|---|
| 13. CLOSE TREE | $B_2$ | $B_2$ | B | $B_2$ | $B_2$ | B | B | B | B | B | B | B | B | B | B | B | B | B | P | B | B | E | E | E | B | B | B | B |
| 14. RELEASE TREE RUNNING TOOL | $B_2$ | $B_2$ | B | $B_2$ | $B_2$ | B | B | B | B | B | B | B | B | B | B | B | B | B | B | P | E | E | E | P | B | B | B | P |
| 15. STROKE UP | B | B | B | B | B | B | B | B | B | B | B | B | B | B | B | B | B | B | B | P | E | E | E | P | B | B | E | $B_3$ |
| 16. STROKE DOWN | B | B | B | B | B | B | B | B | B | B | B | B | B | B | B | B | B | B | B | P | E | B | B | P | B | B | B | P |
| 17. LATCH ONTO TREE CAP OR POD | B | B | B | B | B | B | B | B | B | B | B | B | B | B | B | B | B | B | P | B | B | B | B | P | B | B | B | P |
| 18. UNLATCH CAP OR POD (GRAB RELEASE FAN) | B | B | B | B | B | B | B | B | B | B | B | B | B | B | B | B | B | B | P | B | B | $P_4$ | $B_4$ | $P_4$ | $P_4$ | B | B | P |
| 19. UNLOCK CAP OR POD | B | B | B | B | B | B | B | B | B | B | B | B | B | B | B | B | B | B | P | B | B | $B_5$ | $P_5$ | $B_5$ | $B_5$ | B | B | P |
| 20. STROKE UP W/ CAP OR POD | B | B | B | B | B | B | B | B | B | B | B | B | B | B | B | B | B | B | P | B | B | B | P | B | B | B | E | $B_3$ |
| 21. STROKE UP W/ CAP OR POD | B | B | B | B | B | B | B | B | B | B | B | B | B | B | B | B | B | B | P | B | B | B | P | B | B | B | B | P |
| 22. LATCH CAP OR POD | B | B | B | B | B | B | B | B | B | B | B | B | B | B | B | B | B | B | P | B | B | $P_6$ | $B_6$ | $B_6$ | $P_6$ | B | B | P |
| 23. RELEASE CAP OR POD | B | B | B | B | B | B | B | B | B | B | B | B | B | B | B | B | B | B | P | B | B | B | B | P | B | B | B | P |
| 24. RELEASE FM CAP OR POD (SAME AS #14) | $B_2$ | $B_2$ | B | $B_2$ | $B_2$ | B | B | B | B | B | B | B | B | B | B | B | B | B | B | P | E | E | E | P | B | B | B | P |
| 25. RELEASE FLOW-LINE & ELECT. CONNECTOR | B | B | B | B | B | B | B | B | B | B | B | B | B | B | B | B | B | B | P | B | B | E | E | E | B | B | B | B |
| 26. REENTRY RELEASE TOOL | B | B | B | B | B | B | B | B | B | B | B | B | B | B | B | B | B | B | B | P | E | E | E | E | B | $P_7$ | $P_7$ | B |
| 27. TREE RUNNING TOOL STAB MOLD | B | B | B | B | B | B | B | B | B | B | B | B | B | B | B | B | B | B | B | P | E | B | B | B | B | B | B | E |

FIG. 4

(numbers not shown are vented to sea)

Mode A

| SURFACE ACCESS NECESSARY TO OPERATOR: | ACCESS ACHIEVED THROUGH SOURCE LINE |
|---|---|
| 26c | G |
| 26j | G |
| 26k | G |
| 26l | M |
| 26m | G |
| 26n | G |
| 26o | N |
| 26p | G |
| 26q | G |
| 26r | O |
| 26s | G |
| 26b | F |
| 26e | H |
| 26f | I |
| 26h | J |
| 26i | K |
| | L |

PRESSURE ALL TIME DURING THIS MODE.

Mode B

| SURFACE ACCESS NECESSARY TO OPERATOR: | ACCESS ACHIEVED THROUGH SOURCE LINE |
|---|---|
| 26a | F |
| 26c | G |
| 26f | I |
| 26s | E |
| 26d | H |
| 26j | J |
| 26k | K |
| 26m | L |
| 26n | M |
| 26p | N |
| 26q | O |

PRESSURE ALL TIME DURING THIS MODE.

Mode C

| SURFACE ACCESS NECESSARY TO OPERATOR: | ACCESS ACHIEVED THROUGH SOURCE LINE |
|---|---|
| 26s | F |
| 26t | G |
| 26u | H |
| 26v | I |
| 26w | J |
| 26x | K |
| 26y | L |
| 26z | M |
| 27a | N |
| 27b | O |

FIG_5

FUNCTION IDENTIFICATION

| OPERATOR # | OPERATOR FUNCTION |
|---|---|
| 26a | SCSSV #1, CONTROL LINE |
| 26b | SCSSV #1, BALANCE LINE |
| 26c | SCSSV's, ONE INCH VALVES |
| 26d | SCSSV #2, CONTROL LINE |
| 26e | SCSSV #2, BALANCE LINE |
| 26f | TREE CONNECTOR LOCK |
| 26g | TREE CONNECTOR UNLOCK |
| 26h | TREE CONNECTOR SECONDARY UNLOCK |
| 26i | TREE CONNECTOR TEST (1" VALVE PORTING TO ANNULUS RUN) |
| 26j | LOWER MASTER #1 |
| 26k | LOWER MASTER #2 |
| 26l | LOWER MASTER ANNULUS |
| 26m | UPPER MASTER #1 |
| 26n | UPPER MASTER #2 |
| 26o | UPPER MASTER ANNULUS |
| 26p | SWAB VALVE #1 |
| 26q | SWAB VALVE #2 |
| 26r | SWAB VALVE ANNULUS |
| 26s | RUNNING TOOL LATCH |
| 26t | RUNNING TOOL UNLATCH |
| 26u | RUNNING TOOL SECONDARY UNLATCH |
| 26v | TREE CAP AND CONTROL POD ACTUATION LOCK |
| 26w | TREE CAP AND CONTROL POD ACTUATION UNLOCK |
| 26x | TREE CAP AND CONTROL POD ACTUATION TOOL RELEASE |
| 26y | TREE CAP AND CONTROL POD ACTUATION TEST |
| 26z | REENTRY TOOL RELEASE |
| 27a | REENTRY TOOL HYDRAULIC CYLINDER UP |
| 27b | REENTRY TOOL HYDRAULIC CYLINDER DOWN |

P
28
E
V
A
30a
B
C
F
24b
26b
V
A
24a
26a
21
30b
B
30t
C
24c
G
26c
V
A
26t
24t
30c
B
C
H
24d
24e
26e
V
A
26d
26u
24u
30d
B
C
I
24f
26f
V
A
26v
24v
30e
B
C
J
24g
26g
V
A
26w
24w
30f
B
30m
C
K
24h
26h
V
A
26x
24x
30g
B
30l
C

FIG_16
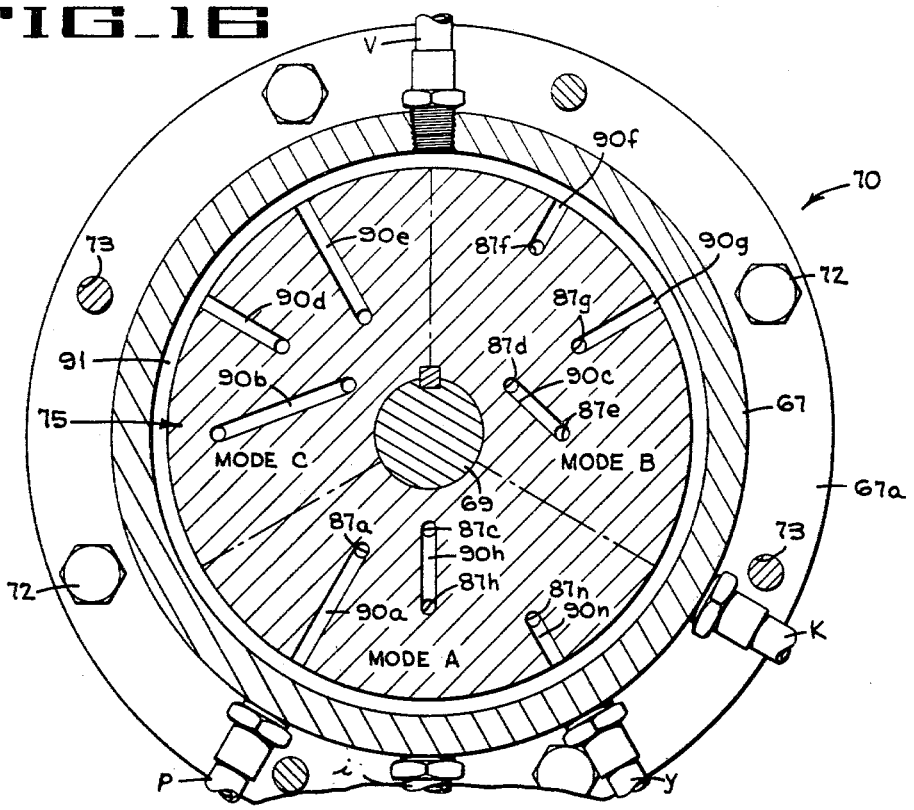
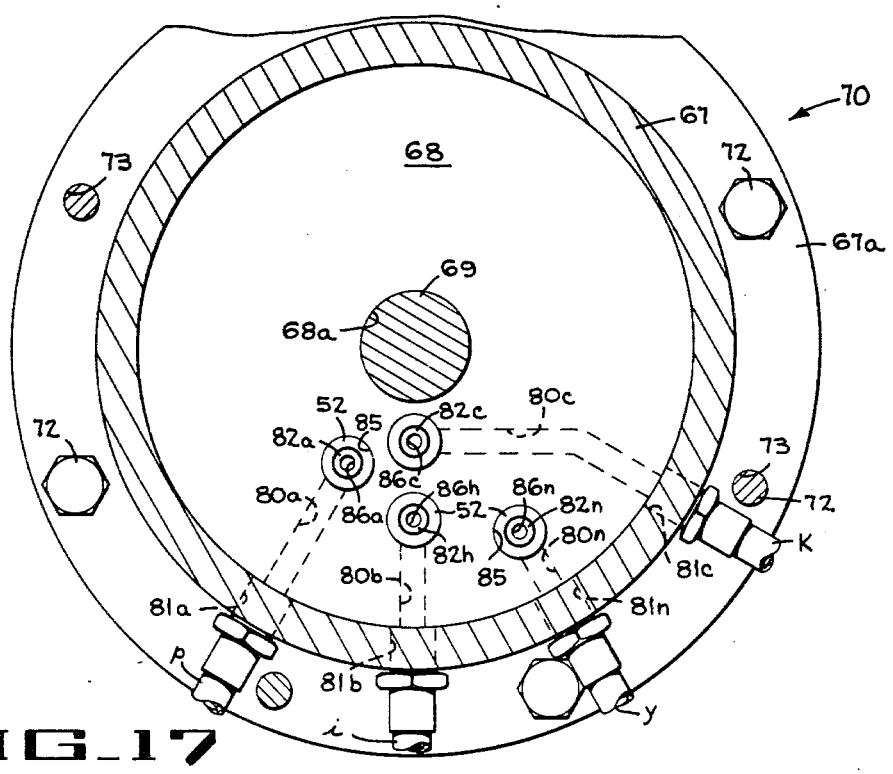
FIG_17

METHOD AND APPARATUS FOR HYDRAULICALLY CONTROLLING SUBSEA WELL EQUIPMENT

This is a division of application Ser. No. 023,933, filed Mar. 26, 1979; Ser. No. 023,933 is a divisional of application Ser. No. 873,323, filed Jan. 30, 1978, now U.S. Pat. No. 4,185,541.

BACKGROUND OF THE INVENTION

1. Field of the Invention

This invention relates to apparatus for hydraulic control of a subsea device, and more particularly to hydraulic apparatus for the individual control of a relatively large number of subsea well devices using only a few hydraulic pressure source lines from a surface vessel to the seafloor.

2. Description of the Prior Art

The production of oil and gas from offshore wells has developed into a major endeavor of the petroleum industry. Wells are commonly drilled several hundred or even several thousand feet below the surface of the ocean, substantially beyond the depth at which divers can work efficiently. As a result, the drilling and operating of a subsea well must be controlled from a surface vessel or from an offshore platform. The testing, production and shutting down of the subsea well is regulated by a subsea Christmas tree which is positioned on top of the subsea wellhead. The Christmas tree includes a plurality of valves having operators which are biased to a non-active position by spring returns, and it has been found convenient to actuate these operators by hydraulic fluid which is directly controlled from the surface vessel. For this purpose, a plurality of hydraulic lines are commonly run from the surface vessel to the wellhead to open and close these valves, and to actuate other devices in the well and the wellhead during installation, testing, and operating the subsea well equipment, and also during workover procedures being performed on the well.

In some of the prior art systems a separate hydraulic line is run from the surface vessel to each of the hydraulically powered devices at the seafloor. Some of these hydraulic lines may be run through a riser, but for many of the subsea operations the riser is too small to contain all of the lines required. A common solution is to employ additional hydraulic lines that are stored on a reel located on the surface vessel, which are made up into a hose bundle that is connected to the outside of the drill pipe or riser and lowered therewith to the seafloor. However, such a hose bundle is expensive, and is heavy and cumbersome to handle simultaneously with the drill pipe or riser, particularly in deep water.

Other prior art equipment uses an electrical cable that is fed off a reel located on the surface vessel as the riser is lowered to the well in a manner similar to the hose bundle. This cable is also expensive, heavy and cumbersome to handle when used outside the drill pipe or riser. Another disadvantage of using an electrical cable inside the drill pipe or riser is that the cable must be in sections, and these sections must be connected together in an end-to-end arrangement at the junction of each section of pipe or riser. This means that a very large number of connections must be made when numerous pipe or riser sections are involved, and each of these connections must function properly in order for the system to work. It has proved to be quite a difficult problem keeping all of these electrical connections working properly in a subsea environment.

What is needed is apparatus which can be used to control a large number of subsea operators with only a few hydraulic source lines between the surface vessel and the wellhead. In some systems this small number of lines could be contained inside the riser or drill pipe. In other systems some of the hydraulic lines could be inside the riser or drill pipe and a few additional lines could be contained in the hose bundle. In either case, a reduction in the number of hydraulic source lines would reduce the expense and the difficulty of handling the hose bundle.

One prior art device that is used in a system for controlling a plurality of remotely positioned hydraulically actuated underwater devices by a single hydraulic control line is disclosed in U.S. Pat. No. 3,993,100, issued November 1976 to Pollard et al. The Pollard et al device involves a plurality of valves each having a pilot, and with the pilot of each valve arranged for actuation by a different pressure level in a signal manifold that is connected to all the pilots.

Another prior art apparatus for this purpose is disclosed in U.S. Pat. No. 3,952,763, issued April 1976 to Baugh. This apparatus includes a valve having a single inlet port and a plurality of outlet ports arranged so that the outlet port that is connected to the inlet port is determined by the magnitude of the pressure that is applied to said inlet port.

SUMMARY OF THE INVENTION

The present invention overcomes some of the disadvantages of the prior art systems by using a multiple-position subsea valve having a plurality of sections with each section having an inlet port, a vent port and a plurality of outlet ports. A plurality of hydraulic lines each having a hydraulic switch therein is connected between a source of pressurized hydraulic fluid and the valve, with each of the hydraulic lines being connected to a corresponding one of the inlet ports of the valve. Each of the outlet ports of the valve is connected to a corresponding one of the subsea operators. The valve is mounted at the subsea location so that only a few hydraulic source lines are needed between the source of hydraulic fluid and the subsea location. These hydraulic source lines can be run through a riser or collected together into a relatively small hose bundle having a reduced number of conductors extending between the surface vessel and the subsea location. The hydraulic switches can be mounted on a surface vessel or a fixed platform, and each of the switches can be used to control several subsea operators, one at a time. The subsea operator which is being controlled by a given switch is determined by the position of the multiple-position valve. The present invention can be used to reduce the number of hydraulic lines needed to control many different types of subsea devices, such as wellheads, running tools and other subsea equipment that requires a plurality of hydraulic control lines.

BRIEF DESCRIPTION OF THE DRAWINGS

FIGS. 3A and 3B comprise a table which shows the positions of the valves and switches as related to the various operations at the subsea well.

FIG. 4 comprises a table which illustrates the correlation between the operator which is energized, the source line used, and the position of the multiple-position valve.

FIG. 5 comprises a table which illustrates the correlation between the function of each subsea operator and the designation number of that operator.

FIG. 16 is a horizontal section taken along line 16—16 of FIG. 15.

FIG. 17 is a horizontal section taken along line 17—17 of FIG. 15.

DESCRIPTION OF THE PREFERRED EMBODIMENT

Figure 1:
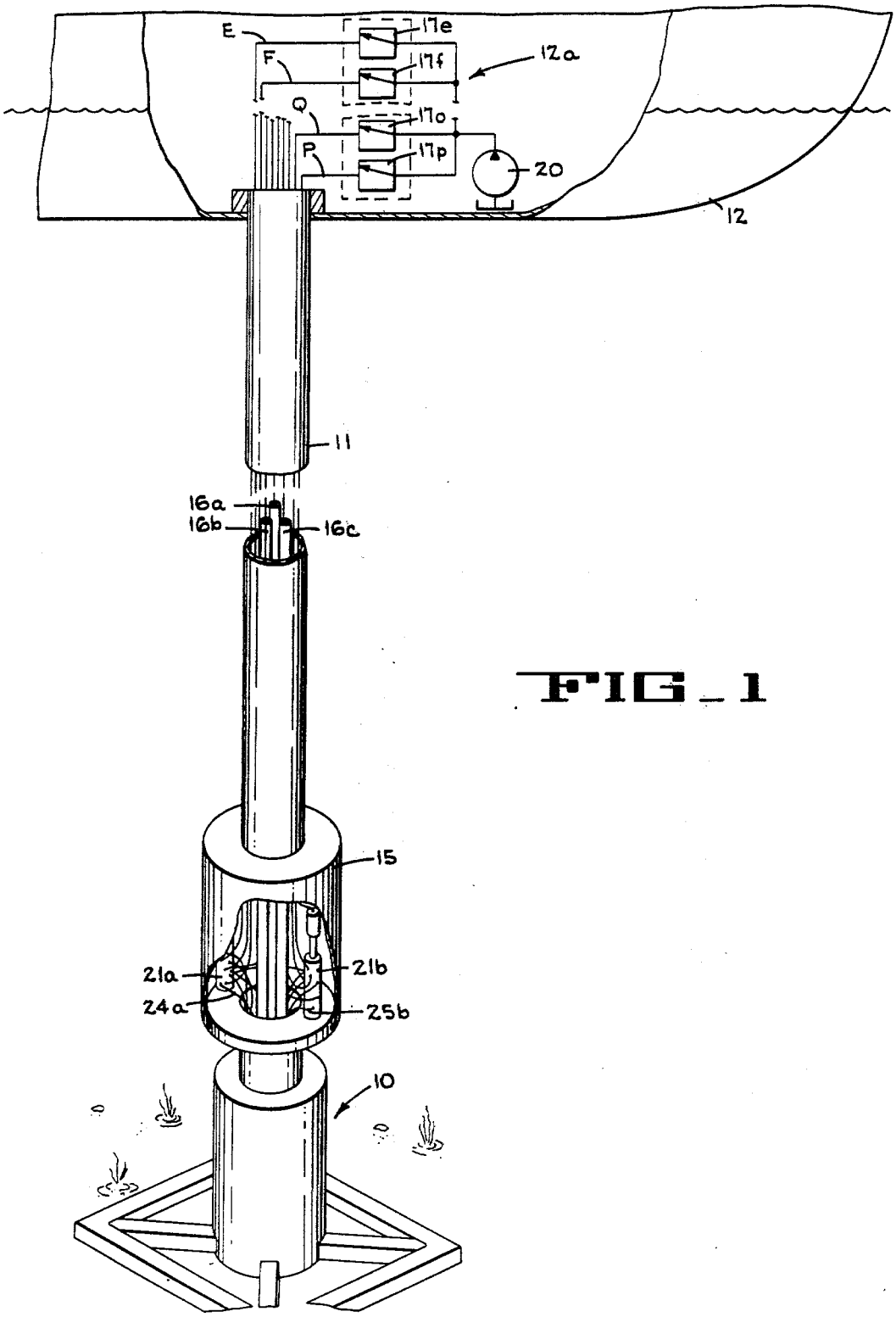
FIG. 1 is a diagrammatic view, partly in elevation and partly in perspective with portions broken away, of a subsea wallhead system in which the apparatus of the present invention is used.
Figure 2:
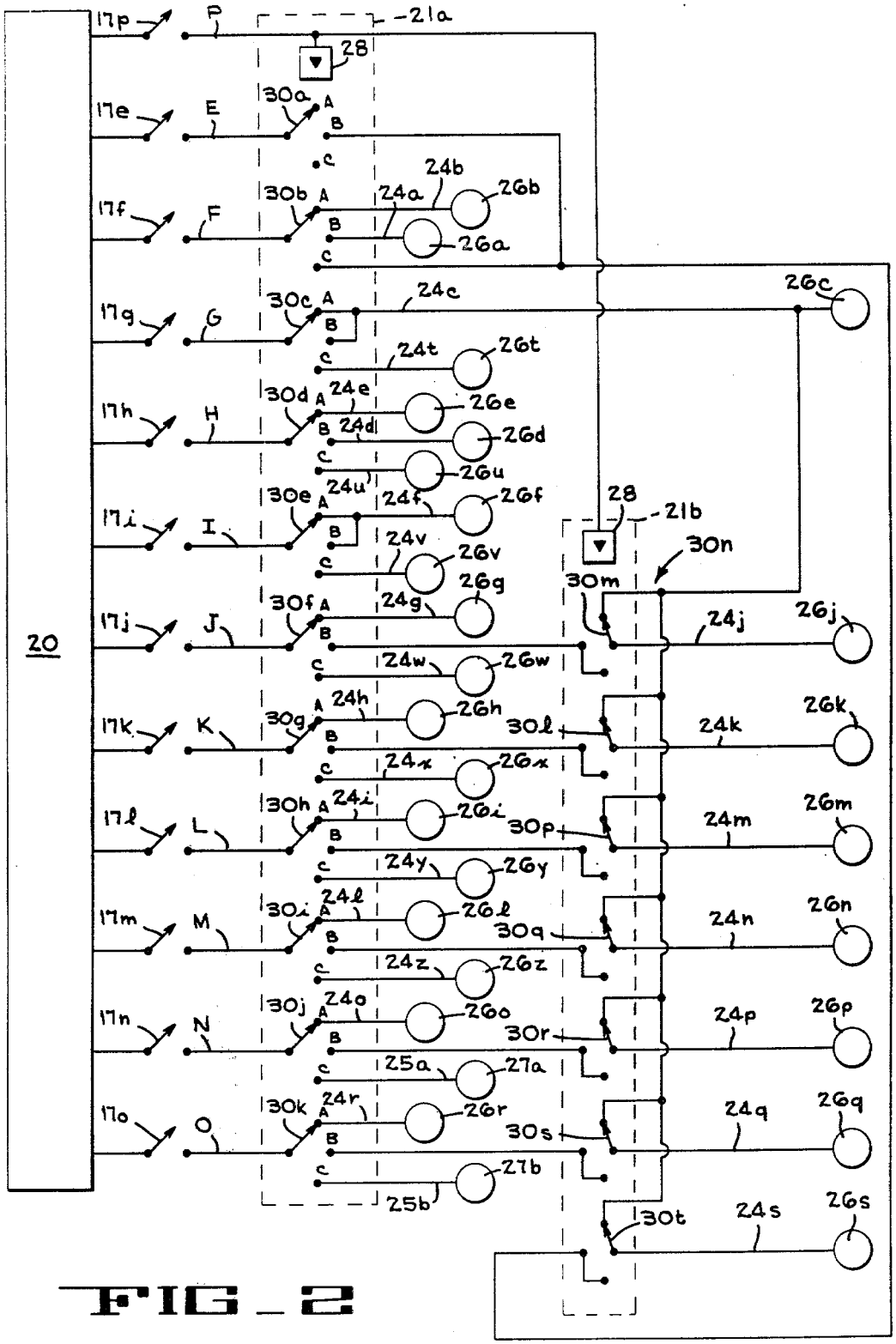
FIG. 2 is a schematic of the switching and valve circuitry of the present invention.

FIGS. 1 and 2 diagrammatically illustrate hydraulic apparatus for controlling many valves or other subsea wells while using only a few hydraulic pressure source lines. The present invention is diagrammatically illustrated in FIGS. 1 and 2 as employed with a completion/workover riser or other type of riser 11 having its upper end connected to a control center 12*a* on a surface vessel 12, and the riser's lower end connected to a valve container 15 that is mounted on a subsea well Christmas tree diagrammatically illustrated at 10. Within and extending between the valve container 15 and the vessel 12 are a plurality of hydraulic pressure source lines E, F, G, H, I, J, K, L, M, N, O and P (not all shown) and three tubing runs 16*a*, 16*b* and 16*c*. The upper ends of the source lines E–P are each connected to a corresponding one of a plurality of hydraulic switches 17*e*, 17*f*, 17*g*, 17*h*, 17*i*, 17*j*, 17*k*, 17*l*, 17*m*, 17*n*, 17*o* and 17*p* (not all shown), and each of the switches 17*e*–17*p* are connected to a hydraulic pump 20 which provides pressurized hydraulic fluid to the source lines when these switches are closed. The lower end of each of the source lines E–P is connected to a corresponding one of a plurality of inlet ports on a pair of multiple-position hydraulic valves 21*a*, 21*b*, each valve having a larger number of outlet ports. A plurality of outlet lines 24*a*–25*b* (FIGS. 2, 6*a*, 6*b*) are each connected between a corresponding one of the outlet ports of the valves 21*a*, 21*b* and one of a plurality of wellhead operators 26*a*–27*b*. These operators are used to open and close valves, connect and disconnect tree caps, control pods, etc., and provide installation, testing and operation of the well.

The schematic diagram of FIG. 2 discloses hydraulic circuitry for controlling a total of twenty-eight subsea operators using only twelve hydraulic lines between the hydraulic pump 20 (on the surface vessel) and the valves 21*a*, 21*b* (located on the seafloor). It should be noted that some of the outlet ports from the valve 21*a* are not used, so a few more operators could be controlled by the apparatus if these operators were needed.

The various steps of installing, testing and maintaining a typical subsea wellhead are listed in FIGS. 3A, 3B where these steps have been grouped together under three modes of operations or groups of steps. FIGS. 3A and 3B comprise a single chart in which the various operations to be performed are listed in a single column at the left of the chart while across the top of the chart (FIG. 3A) are listed the various subsea operators which need to be controlled from the surface vessel. At the intersection of the rows which list the operations and the column which lists the operator is a letter (P,B,E) which indicates that hydraulic pressure or lack of hydraulic pressure is required by the operator during the operation in question. The letter P indicates that the operator requires pressure for a given operation while the letter B indicates that the operator is to be bled or a lack of pressure is required. For example, in step 2, when a subsea tree is being connected, operator 26*c* must be pressurized and operator 26*d* must be bled. Some operators may be either pressurized or bled as represented by the letter "E". Due to space limitations on the chart (FIGS. 3A, 3B) letters are used to represent the various operators which are identified in the function identification list of FIG. 5. For example, operator 26*a* is a control line to the #1 surface controlled subsea safety valve (SCSSV).

The first four steps of the operation listed in the chart (FIGS. 3A, 3B) include the steps for connecting the subsea tree to the well and for removing plugs from the tubing. These four steps have been labelled "mode A" (FIGS. 2, 4, 6A, 6B) and the valve sections 30*a*–30*n* are in the "A position" during these four steps of operation. Steps 5–12 of the operation (FIG. 3A) include the steps for testing the subsea tree and the wellhead after the installation and these steps have been labelled "mode B" (FIGS. 2, 4, 6A, 6B) and the valve sections 30*a*–30*n* are in the "B position" during these steps of the operation. The steps 13–27 (FIG. 3B) include the various workover operations; these steps have been labelled "mode C" (FIGS. 2, 4, 6A, 6B) and the valve sections 30*a*–30*n* are in the "C position" during these steps of the operation. The various steps of the operation are controlled directly by the hydraulic switches 17*e*–17*p* (FIGS. 1 and 2) on the surface vessel 12. The modes A, B and C have been used as basis for designing the member of sections and the number of positions needed in the multiple-position valves 21*a*, 21*b*.

For example, when the valves 21*a*, 21*b* (FIGS. 2, 6A, 6B) are in the A position the switch 17*f* controls the hydraulic power for the operator 26*b*. At the same time the switch 17*g* controls the hydraulic power for the operators 26*c*, 26*j*, 26*k*, 26*m*, 26*n*, 26*p*, 26*q* and 26*s*. When the valves 21*a*, 21*b* are in the B position the switch 17*f* controls the hydraulic power for the operator 26*a* and the switch 17*g* controls the power for the operator 26c only. The control of the other operators at the various positions of the valves may be best seen by referring to FIG. 2. The vent or bleed connections of the valve are not shown in FIG. 2 in order to more clearly show the hydraulic input control circuitry; however, these vent connections may be seen in FIGS. 6A, 6B.

The system is preferably vented to sea with liquid from the various vents being discharged directly into the sea. In a vent-to-sea hydraulic system the hydraulic fluid contains a large percentage of water, for example, it may be 95% water. This results in a hydraulic fluid having a specific gravity of approximately 1 so that a pressure balance is achieved at the outlet of the subsea valve. The valve vents may also be connected back to the surface, but this requires at least one additional hydraulic line between the valve and a surface vessel, to return the hydraulic fluid to the hydraulic pump.

Figure 6A:
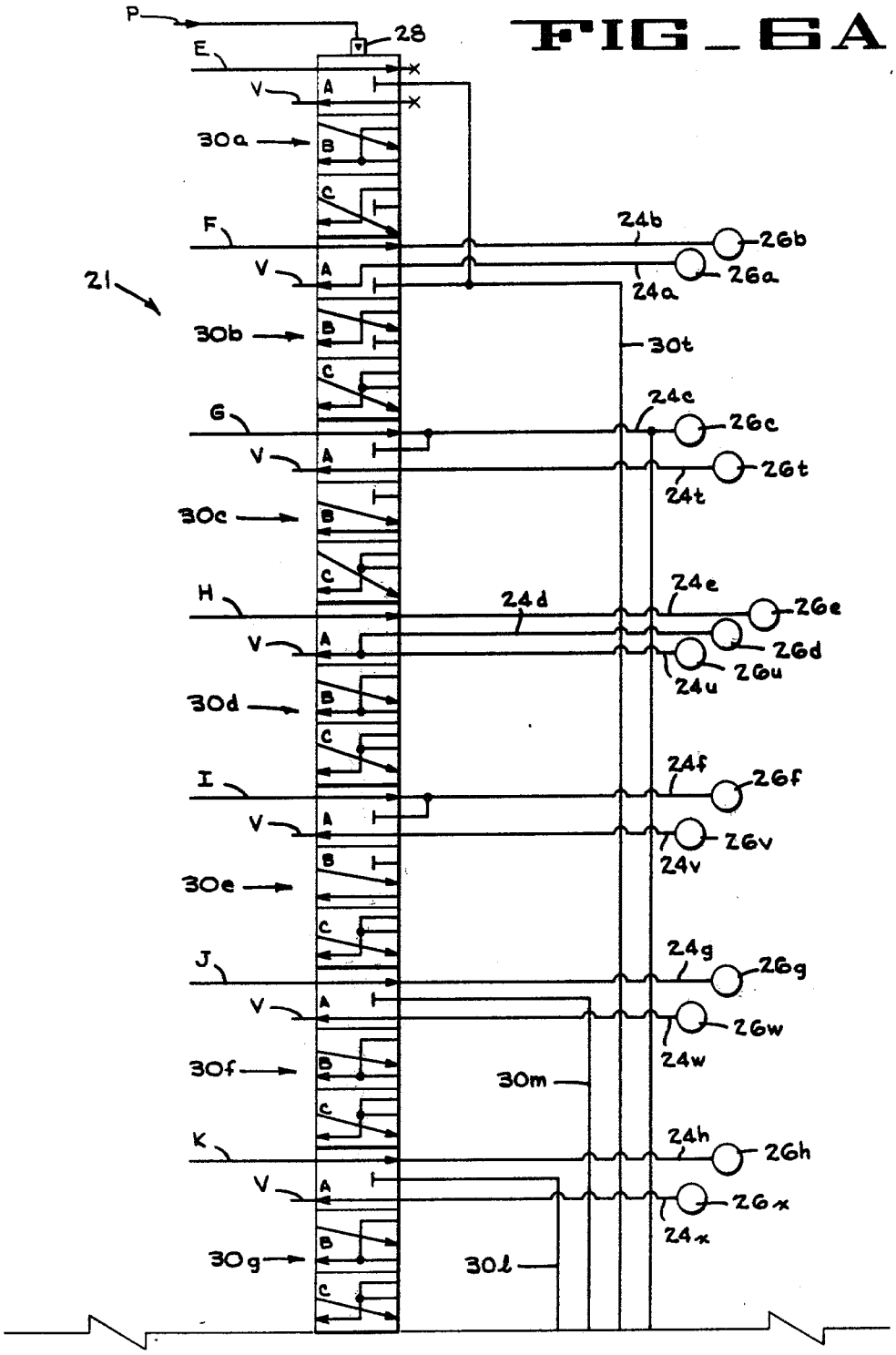
FIGS. 6A and 6B comprise a schematic of the subsea valve.
Figure 6B:
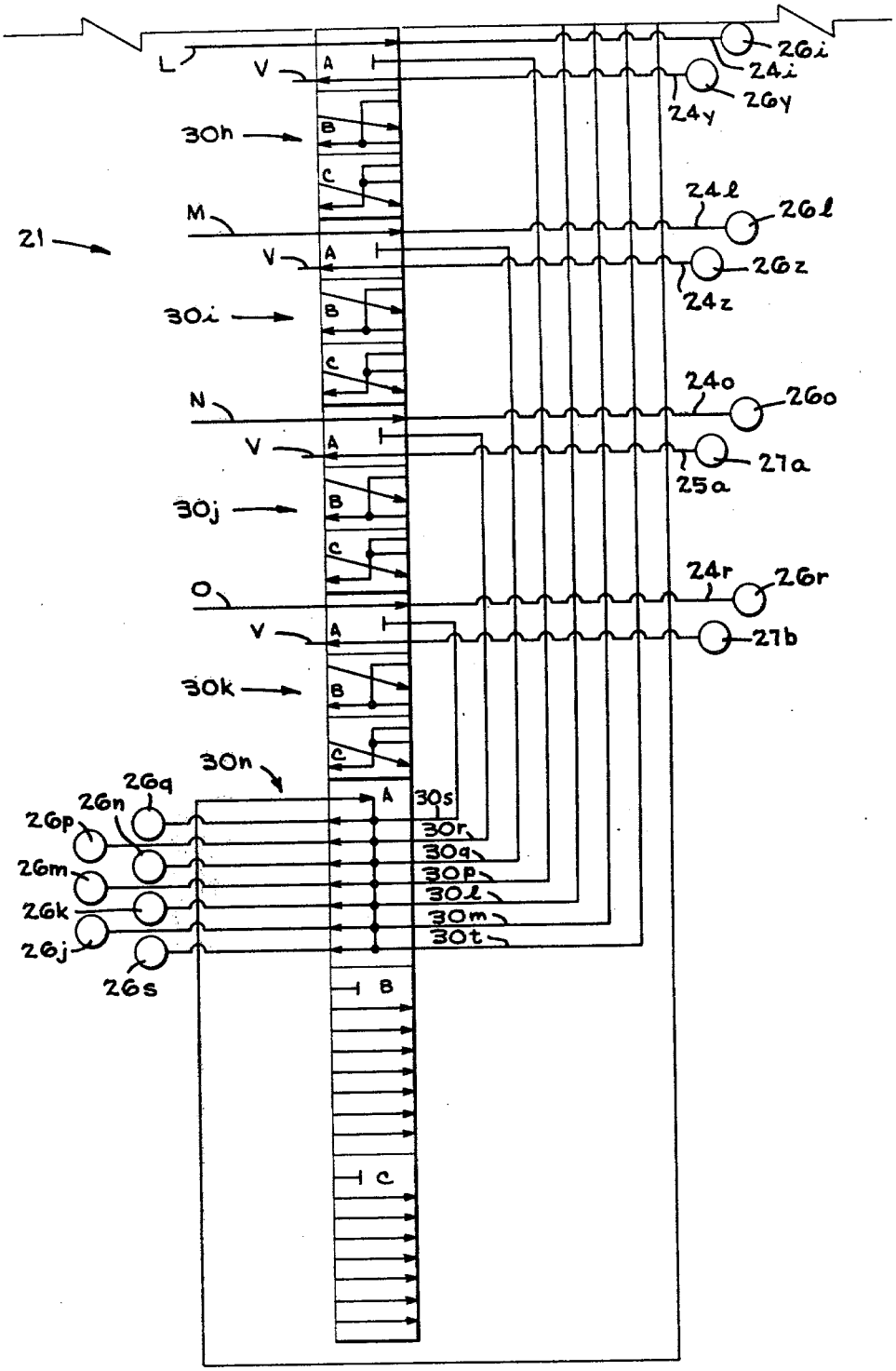
Figure 7:
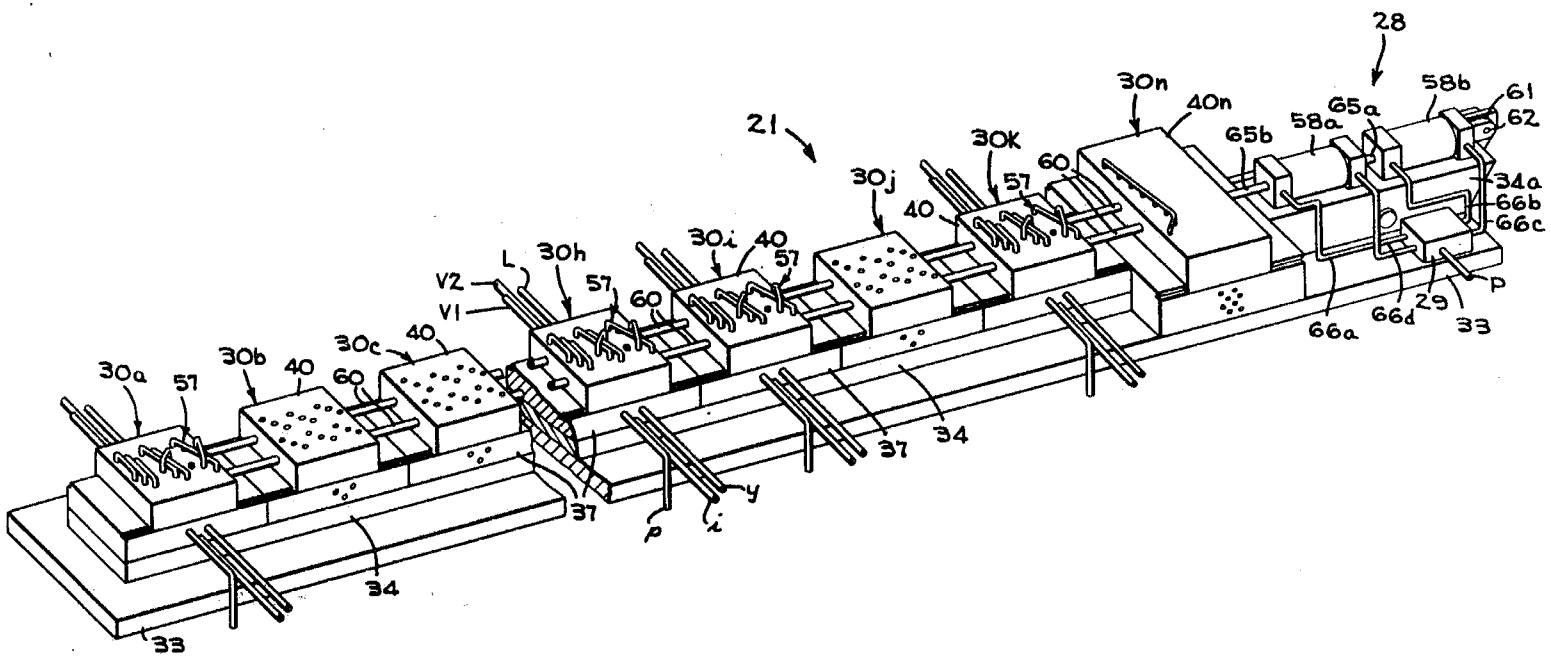
FIG. 7 is an isometric view of one embodiment of the subsea valve and valve actuator embodying the features of the present invention.

FIGS. 6A, 6B and 7 disclose details of a 3-position, pilot-operated hydraulic valve 21 having a plurality of sections 30a–30n with each section being operable in the three different modes. These sections may be placed end-to-end to form a single valve if the container 15 (FIG. 1) is long enough to contain such a valve or these sections may be arranged to form two or more valves. The embodiment disclosed in FIGS. 1 and 2 connects the sections into a pair of valves 21a and 21b. The various sections 30a–30n of the valves 21a, 21b are shown in more detail in FIGS. 6A and 6B and with a portion of one of the valves being shown in FIG. 7. Each of the valves 21a, 21b includes a pilot section 28 which shifts the valve from one operating position to the next operating position each time that a predetermined minimum pressure is applied to the pilot inut line P. Details of the operation of the pilot section will be discussed in connection with the physical construction of the valves as shown in FIGS. 7–18.

One embodiment of the valve 21 as shown in FIGS. 7–12 comprises a linear-slide, multiple-section flat valve having external programmable jumpers so that the configuration of the valve can readily be changed. The valve sections 30a–30n are mounted on a base 33 (FIG. 7) with the larger section 30n being mounted directly on the base 33 and the smaller sections 30a–30n having a spacer 34 mounted between the base and each of the sections. Each of the sections includes a lower valve block 37 (FIGS. 7–9) which is connected to the base 33 by a plurality of machine screws 38. Each section includes a sliding jumper block 40 which is slidably connected to the lower valve block 37 by a dove-tail joint to insure a tight, yet movable fit between the jumper block 40 and the valve block 37.

The lower valve block 37 (FIG. 9) includes a plurality of passageways 41a–41n (only a portion of which are shown) which interconnect a plurality of inlet-outlet ports 44a–44n with corresponding ones of a plurality of internal ports 45a–45n. The jumper block 40 (FIG. 9) includes a plurality of vertical passageways 47a–47n, only two of which are shown, each connected between an internal port 48a–48n and a corresponding one of a plurality of jumper ports 49a–49n. An annular shear-seal ring 52 and a wave spring 53, both positioned in an annular recess 54 about each of the internal ports 45a–45n, provide a fluid-tight seal between each of the vertical passageways 47a–47n in the jumper block 40, and the corresponding vertical passageways 41b–41c in the valve block 37.

A plurality of programmable jumper lines 57a–57n (FIGS. 7–10) are connected between the various jumper ports 49a–49n of the jumper block 40 to provide various combinations of connections between the outlet lines i, p, y and the source and vent lines L, V1, V2. The ends of the jumper lines 57a–57n are each provided with a tube fitting 58 which is threaded into the upper end of a corresponding one of the jumper ports 49a–49n. The ends of the outlet lines i, p, y and the lines L, V1, V2 are each threaded into a corresponding one of the inlet/outlet ports 44a–44n.

Figure 10:
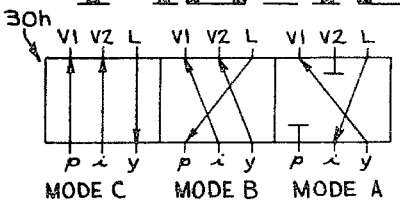
FIG. 10 comprises a schematic of the section of the valve shown in FIG. 8.

The jumper block 40 (FIG. 8) can be moved into any one of the modes A, B or C to provide the various combinations of outlet to source and vent connections shown in FIG. 10. The jumper blocks 40 are moved from one mode or position to another by an actuator section 28 (FIG. 7) that includes a pair of hydraulic cylinders 58a, 58b and a pilot control section 29 having a plurality of switching valves 59a–59d (FIG. 12) with each of the valves 59a–59d shown in the deenergized position. The valves 59b, 59c switch from the deenergized position to the energized position whenever a pressure of more than 1000 psi is applied to the pilot line P, and the valves 59a, 59d switch to the energized position whenever a pressure of more than 2000 psi is applied to the same pilot line P.

Figure 11:
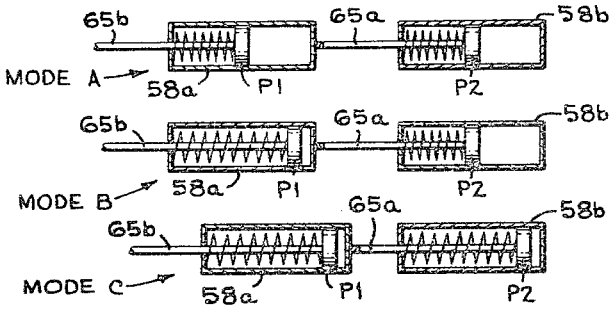
FIG. 11 is a diagrammatic view of a portion of the valve actuator illustrating the positions of the actuator corresponding to different operating modes of the valve.
Figure 12:
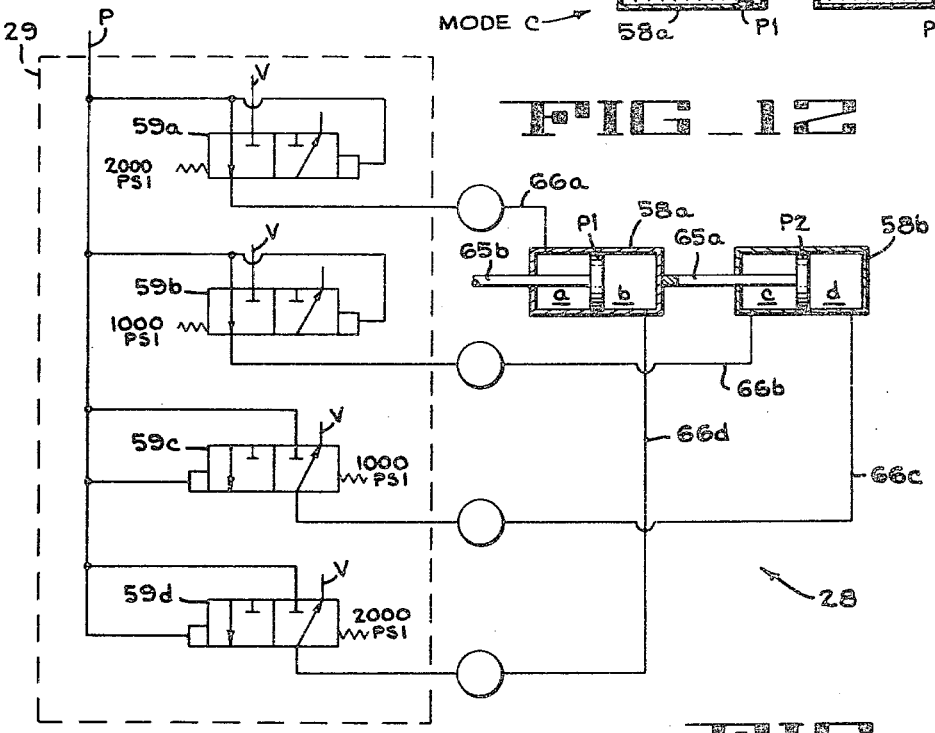
FIG. 12 comprises a schematic of the valve actuator.

The hydraulic cylinders 58a, 58b are positioned (FIG. 7) at one end of the valve 21 with the cylinder 58b fixed to a spacer 34a by a clevis 61 and pin 62. The cylinder 58a is supported above the spacer 34a by a pair of rods 65a, 65b (FIGS. 7, 11, 12). The rod 65a interconnects the cylinder 58a and a piston P2 inside the cylinder 58b, and the rod 65b interconnects the sliding jumper block 40n and a piston P1 inside the cylinder 58a. Thus, although the cylinder 58b is fixed relative to the spacer 34a and the base 33 (FIG. 7), the pistons P1, P2 and the cylinder 58a are free to move along the length of the spacer 34a. A plurality of hydraulic lines 66a–66d between the pilot control section 29 and the cylinders 58a, 58b provide the hydraulic power to move the pistons P1, P2. A plurality of rods or connecting links 60 rigidly interconnect the jumper blocks 40 so that each section of the switch is always in the same mode of operation.

When the hydraulic pressure from the surface vessel applied to the source line P (FIGS. 6A, 7, 12) is somewhat less than 1000 psi, fluid flows through the valve 59a and line 66a to the chamber a of the cylinder 58a, forcing the piston P1 (FIG. 12) to the right and moving fluid from the chamber b through line 66d and the valve 59d to the vent V. At the same time, fluid flows through the valve 59b and line 66b to the chamber c of the cylinder 58b, forcing the piston P2 to the right and moving fluid from the chamber d through the line 66c and the valve 59c to the vent V. This places both pistons P1, P2 in their fully retracted position, designated mode C in FIG. 11, with the jumper blocks 40 (FIGS. 7, 8) above the right portion of each of the lower valve blocks 37, so that the mode C jumper lines 57a–57c (FIG. 8) are connected between the outlet lines p, i, y, and the vent and source lines V1, V2, L, respectively.

Figure 8:
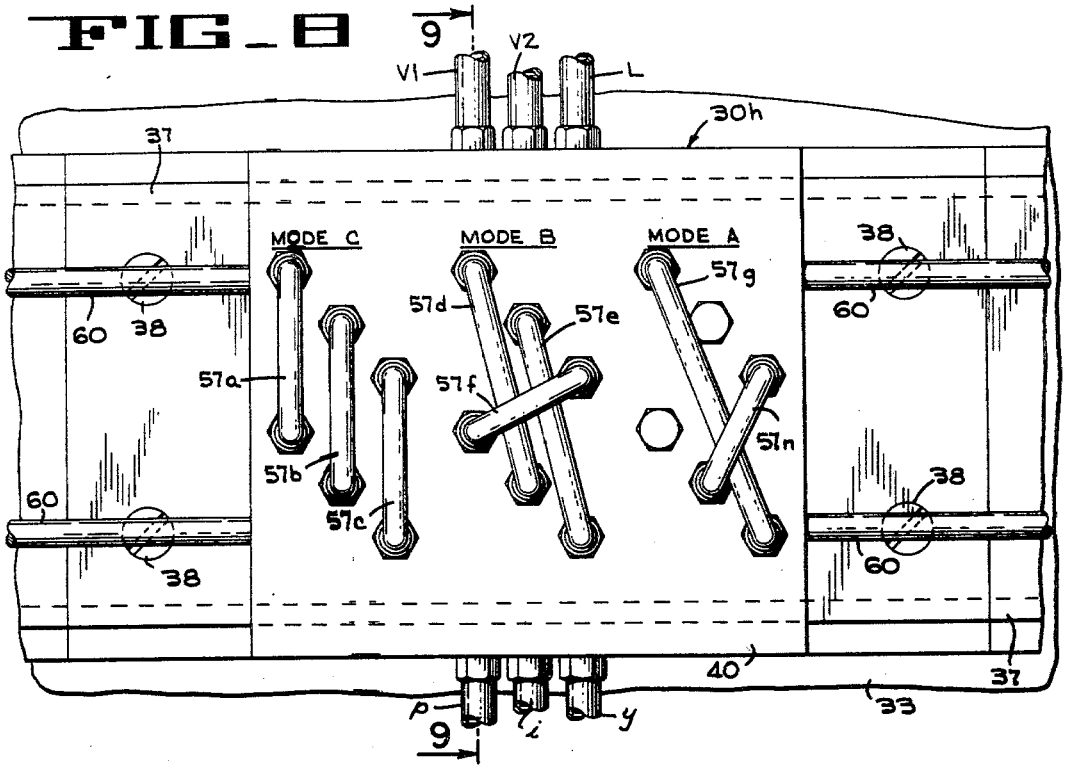
FIG. 8 is an enlarged plan view of a portion of the subsea valve of FIG. 7.
Figure 9:
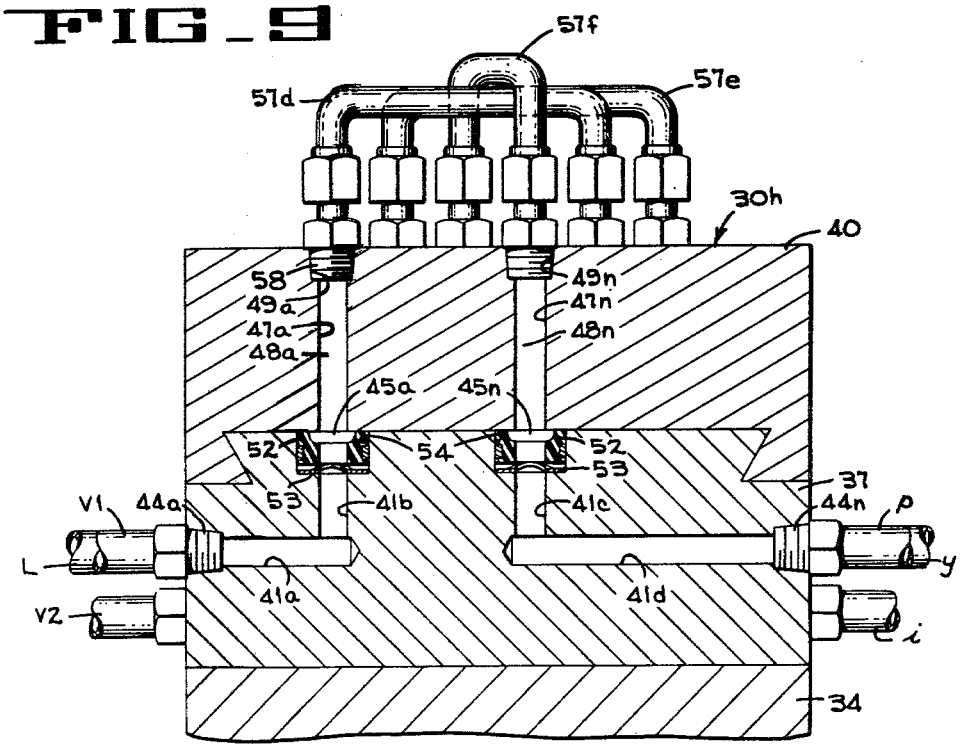
FIG. 9 is a vertical section taken along line 9—9 of FIG. 8.

When the hydraulic pressure from the source line P (FIG. 12) is increased to between 1000 psi and 2000 psi the valves 59b and 59c switch to their energized position wherein fluid flows through the valves 59c and line 66c to the chamber d of the cylinder 58b, thereby forcing the piston P2 to the left and fluid from the chamber c through the line 66b and valve 59b to the vent V. As the piston P2 moves to the left, the rod 65a (FIGS. 7, 11) is extended from the cylinder 58*b*, thereby moving the cylinder 58*a* to the left and the jumper blocks 40 into the mode B as shown in FIGS. 8, 10, 11.

When the hydraulic pressure from the source line P (FIG. 12) is increased to above 2000 psi the valves 59*a*, 59*d* are also switched to their energized position wherein fluid flows through the valve 59*d* and line 66*d* to the chamber b of the cylinder 58*a*, forcing the piston P1 to the left and moving fluid from the chamber a through the line 66*a* and the valve 59*a* to the vent V. This extends both the rods 65*a*, 65*b*, and moves the jumper blocks 40 into the mode A (FIGS. 8, 10, 11). Thus, the mode of operation of the linear-slide valve can be controlled from a remote position by applying different hydraulic pressures to the pilot valve 29.

Another embodiment of the invention is shown in FIGS. 13–18 that illustrate a rotary type valve 70 with internal passageways instead of the external jumpers of the first embodiment illustrated in FIGS. 7–12. These internal passageways can be drilled or otherwise formed to provide the same passageway system provided by the external jumpers, so that the ultimate function of both valves is the same. The valve 70 comprises a plurality of sections 30*a*–30*n* (FIG. 18) each having a cylindrical outer housing 67 with a flange 67*a* (FIGS. 14, 15) at one end thereof, and a wall 68 that encloses the other end thereof. The wall 68 includes a central bore 68*a* having an annular shaft 69 rotatably mounted therein. The sections are each bolted to at least one adjacent section by a plurality of bolts 72 (FIGS. 14, 16–18) extending through bores 73 in the flanges 67*a*.

Each section (FIGS. 14, 15) includes an annular rotor 75 mounted between the wall 68 and a cap 76 which is threaded to the upper end of the housing 67. The shaft 69 is rotatably mounted through an annular bore 92 in the center of the cap 76, and the shaft is secured to the rotor 75 (FIG. 14) by a key 83. A thrust bearing 77 (FIG. 15), positioned in an annular groove 79 in the bottom of the cap 76, provides a bearing surface which rests against the top surface of the rotor 75 to limit upward movement of the rotor. The wall 68 (FIG. 15) includes a plurality of passageways 80*a*–80*n* which interconnect a plurality of inlet/outlet ports 81*a*–81*n* (FIGS. 14, 15) with corresponding ones of a plurality of internal ports 82*a*–82*n* (FIG. 15). An annular shear-seal ring 52 and a wave spring 53, both positioned in an annular recess 85 about each of the internal ports 82*a*–82*n*, provide a fluid-tight seal between each of the vertical passageways 86*a*–86*n* in the wall 68, and the corresponding vertical passageways 87*a*–87*n* in the rotor 75.

A plurality of horizontal passageways 90*a*–90*n* (FIGS. 14–16) interconnect the various vertical passageways 87*a*–87*n* in the rotor 75 and connect other vertical passageways 87*a*–87*n* with a chamber 91, between the outer housing 67 and the rotor 75. This chamber 91 is vented to the sea by a vent V (FIG. 14) so that only a single vent is needed instead of the pair of vents employed in the embodiment of FIGS. 7–12. A pair of annular seals 95 (FIG. 15) mounted around the shaft 69, and an annular seal 96 mounted between the housing 67 and the cap 76, prevent leakage of fluid from the chamber 91.

The upper end of the shaft 69 (FIG. 18) is attached to a mechanism 98 which rotates the multiple-position valve 70 into the positions or modes A, B, C. The mechanism 98 includes a lower ratchet section 99 having a plurality of teeth 99*a*, and an upper ratchet section 100. The upper ratchet section 100 is biased against the lower ratchet section 99 by a spring 103 which is wound about a shaft 104. The shaft 104 is connected between the upper ratchet section 100 and a spur gear 107 which is connected to a movable rack 108. The rack 108 is connected to a piston 109 by a rod 112 which is mounted inside a cylinder 113. The piston is biased toward the left end of the cylinder 113 by a spring 114.

Each time the hydraulic cylinder 113 is energized by hydraulic fluid from the pilot input line P, the rack 108 moves toward the right (FIG. 18) thereby causing the spur gear 107, the ratchet sections 100, 99, the shaft 69 and each of the rotors 75 (FIG. 15) to rotate 120 degrees in a clockwise direction (as viewed from above) with the vertical passageways 87*a*–37*n* in the rotors stopping at a position adjacent the vertical passageways 86*a*–86*n* in the wall 68 (FIG. 15). When the hydraulic cylinder 113 (FIG. 18) is deenergized the spring 114 causes the piston 109, the rod 112 and the rack 108 to move to the left and causing the upper ratchet section 100 to rotate counterclockwise. However, the lower ratchet section remains stationary due to the friction between the seals 95 (FIG. 15) and the shaft 69 and due to the shape of the teeth on the ratchet sections 99 and 100 which permit the upper ratchet section 100 to rotate counterclockwise while the lower ratchet section 99 remains in a fixed position. Each 120 degree rotation of the shaft 69 causes the valve to change from mode A to mode B, or from mode B to mode C, or from mode C to mode A.

The various connections between the inlet ports and the outlet ports can be seen in FIGS. 2, 6*a* and 6*b*. For example, when the valve is in mode A, in section 30*b* of the valve the inlet line F is connected to the outlet line 24*b* and to the operator 26*b*. When the valve is moved into mode B, the inlet line F is connected to the outlet line 24*a* and to the operator 26*a*. The section 30*n* (FIGS. 2, 6*b*) of the valve connects all of the operators 26*j*, 26*k*, 26*m*, 26*n*, 26*p*, 26*q* and 26*s* in parallel when the valve is in mode A so that power to these operators is all controlled by the switch 17*g*. In the B and C modes of the valve, each of these operators is controlled by an individual one of the switches 17*j*–17*p*. It may be noted that the "B" and "C" portions of the 30*n* section of the valve are identical, but both portions are needed as all of the sections of the valve change from mode B to mode C when the pilot valve causes the rotors 75 (FIG. 16) to rotate from position B to position C.

Figure 14:
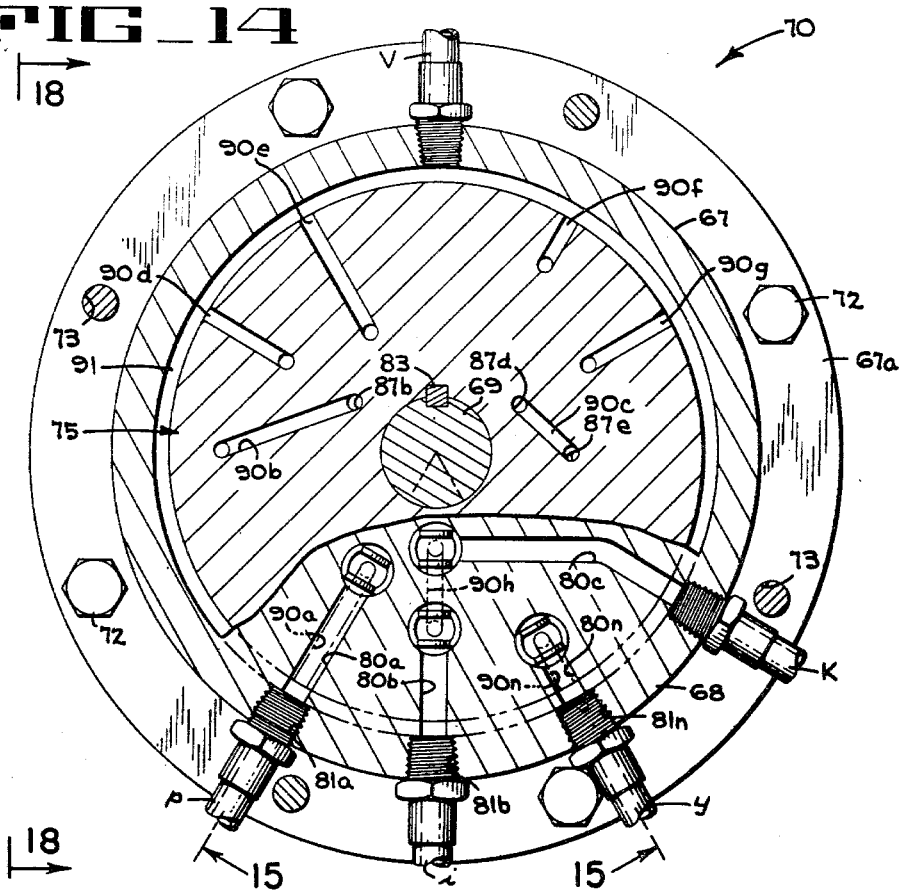
FIG. 14 is a horizontal section of the subsea valve with a portion broken away.
Figure 15:
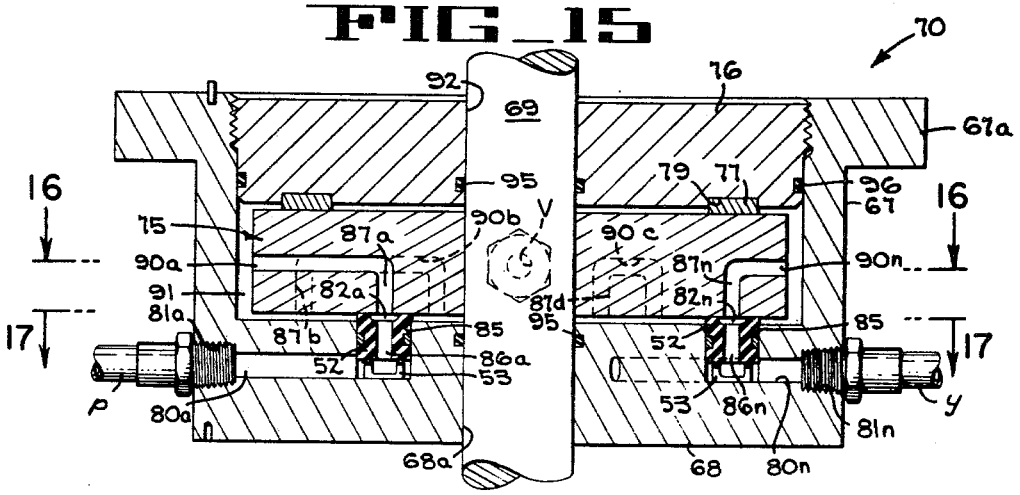
FIG. 15 is a vertical section taken along line 15—15 of FIG. 14.
Figure 18:
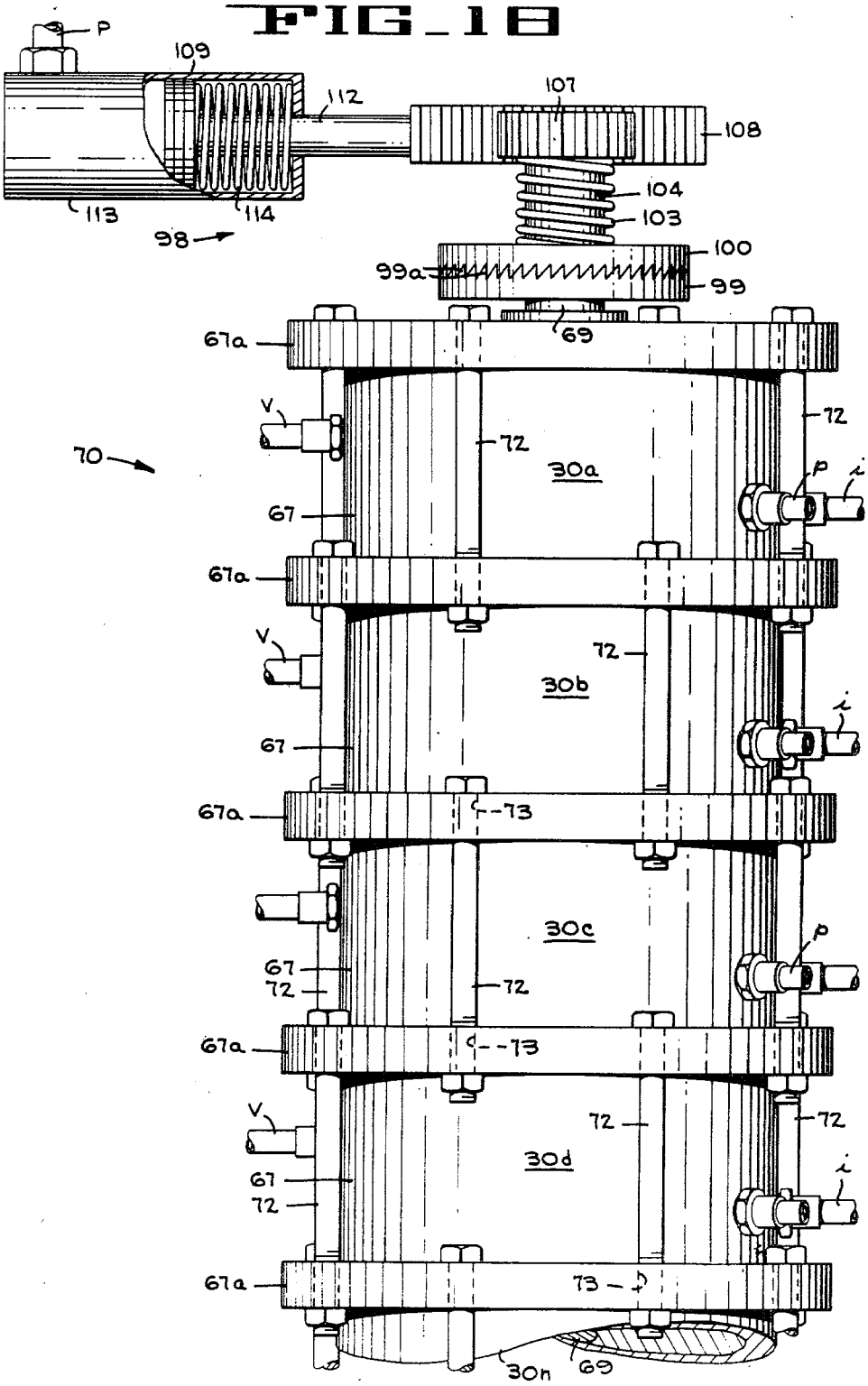
FIG. 18 is a side elevation taken in the direction of the arrows 18—18 of FIG. 14.

The details of the connections for one of the sections of the rotary switch can be seen in FIGS. 10, 14, 16 and 17. As shown in the mode A, the inlet line K is connected to the outlet line i by the horizontal passageways 80*c*, 90*h*, 80*b* (FIG. 14) and the vertical passageways 86*c*, 86*h* (FIG. 17), 87*h*, 87*c* (FIG. 16). The inlet/outlet line p is connected to the vent V by the horizontal passageways 80*a* (FIGS. 14, 15, 17), 90*a* (FIGS. 14–16), the vertical passageways 86*a* (FIGS. 15, 17), 87*a* (FIGS. 15, 16) and the chamber 91 (FIGS. 14–16). In the mode B, the rotor 75 (FIG. 16) is moved 120 degrees clockwise from the position shown in FIG. 16 so that the inlet line K is connected to the inlet/outlet line p by the horizontal passageways 80*a*, 80*c* (FIG. 17), 90*c* (FIGS. 15–16) and the vertical passageways 86*a*, 86*c* (FIG. 17), 87*e*, 87*d* (FIGS. 15–16).

Figure 13:
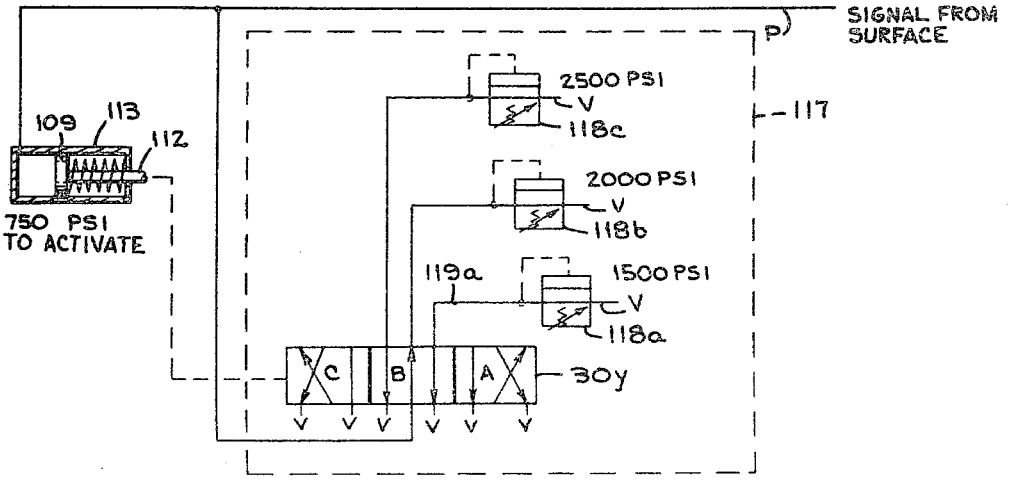
FIG. 13 comprises a schematic of a mode-indicator section of the subsea valve.

A mode-indicator section 117 of the rotary switch 21 as disclosed in FIG. 13 provides means for remotely checking the position or mode in which the switch of FIGS. 14–18 is operating. The mode-indicator section 117 includes a plurality of pressure-relief valves 118a–118c and a valve section 30y (FIG. 13) which is preferably connected to the lower end of the shaft 69 (FIG. 18) although the section 30y could be connected anywhere along the length of the shaft. Each of the pressure-relief valves (FIG. 13) prevents the pressure drop across the valve from exceeding the value shown in the FIG. 13. For example, the maximum pressure drop between the inlet port 119a and the vent port V of the valve 118a is 1500 psi.

Each of the pressure-relief valves 118a–118c is connected to the source line P in a corresponding one of the modes A, B, C and prevents the pressure in the source line P from raising above the pressure drop across the relief valve. A pressure gage (not shown) mounted on the surface vessel 12 (FIG. 1) and connected to the line P is used to indicate the pressure on the line P and thereby indicate the mode of operation of the rotary switch 21. When the pressure in the source line P increases above 750 psi, the piston 109 (FIGS. 13, 18) moves the rack 108, spur gear 107 and the shaft 69 a total of 120 degrees so that the rotary switch moves into one of the modes A, B or C and connects one of the pressure-relief valves to the source line P. For example, in mode B (FIG. 13) the pressure-relief valve 118b is connected to the source line P through the valve section 30y so that the pressure in the source line p cannot increase above 2000 psi. In mode A the pressure-relief valve 118a is connected to the line P so that the pressure in the source line P cannot increase above 1500 psi and in mode C the valve 118c is connected to the line P and the pressure in the line P cannot increase above 2500 psi.

The present invention provides a means for controlling the operation of a relatively large number of subsea operators while using a much smaller number of hydraulic control lines between a surface vessel or a surface platform and a multiple-position subsea valve which is positioned near the subsea operators. The multiple-position valve has a plurality of sections with each section having an input port, a vent port and a plurality of output ports. Connected between each of the input ports and a source of hydraulic power on the surface vessel is a source line having a hydraulic switch connected therein. A separate subsea operator may be individually controlled by a corresponding one of the hydraulic switches at each position of the subsea valve.

Although the best mode contemplated for carrying out the present invention has been herein shown and described, it will be apparent that modification and variation may be made without department from what is regarded to be the subject matter of the invention.

What is claimed is:

1. A fluid control valve comprising:

a valve block having a plurality of inlet/outlet ports, a plurality of internal valve ports and a plurality of passageways interconnecting each of said internal valve ports with a corresponding one of said inlet/-outlet ports;

a jumper block having a plurality of jumper ports, a plurality of internal block ports, and a plurality of passageways interconnecting each of said internal ports with a corresponding one of said jumper ports;

a plurality of programmable jumper lines;

means for connecting the ends of each of said jumper lines to a selected pair of said jumper ports to selectively interconnect said passageways in said jumper block; and means for mounting said jumper block in sliding contact with said valve block to interconnect said internal valve ports with corresponding ones of said internal block ports.

2. A fluid control valve as defined in claim 1 including:

sealing means connected between each of said internal valve ports and a corresponding one of said internal block ports.

3. A fluid control valve as defined in claim 1 including:

means for slidably moving said jumper block relative to said valve block, and means for selectively stopping said jumper block in position to connect said internal valve ports in said valve block with said internal block ports in said jumper block.

4. A multiposition hydraulic directional control valve comprising:

a base member having a plurality of inlet ports, a plurality of outlet ports and a plurality of vent ports;

a slidable member movable with respect to said base member;

an actuator connected to said slidable member to move said slidable member into a plurality of distinct positions relative to said base member;

means for connecting each of said inlet ports to an outlet port in each of said distinct positions;

means for connecting at least one of said outlet ports to one of said vent ports in at least one of said distinct positions; and means for blocking at least one of said outlet ports in at least one of said distinct positions.

5. A multiposition control valve is defined in claim 4 wherein said blocking means comprises metal seated shear-seals positioned inside said valve.

6. A multiposition control valve as defined in claim 4 wherein said connecting means includes a programmable jumper assembly.

7. A multiposition control valve as defined in claim 4 wherein said actuator includes hydraulic means for switching said valve into a plurality of distinct positions.

8. A multiposition control valve as defined in claim 4 wherein said actuator includes hydraulic means for switching said valve into a plurality of distinct positions and means for switching said actuator from one position to a next position in response to a change in hydraulic pressure.

9. A multiposition control valve as defined in claim 8 including means for indicating the position of said valve and said actuator at a location remote from said valve and said actuator.

10. A multiposition control valve as defined in claim 8 wherein successive increases in hydraulic pressure causes said actuator to move said slidable member from position 1 to position 2 to position 3, and successive decreases in pressure causes said actuator to move said slidable member from position 3 to position 2 to position 1.

11. A linear hydraulic selector valve having an inlet port, a vent port and a plurality of outlet ports, said valve comprising:

a base member;

a slidable member that is movable linearly with respect to said base member to a plurality of distinct positions;

means for connecting said inlet port to one of said outlet ports in each of said distinct positions;

means for blocking any of the other outlet ports in any of said positions; and means for connecting said vent port to any of said other outlet ports in any of said positions.

12. A linear hydraulic selector valve as defined in claim 11 including a plurality of internal ports in said base member and in said slidable member, and sealing means disposed in said internal ports to provide fluid-tight seals between internal ports in said base member and internal ports in said slidable member.

13. A linear hydraulic selector valve as defined in claim 11 including a plurality of internal ports in said base member and in said slidable member, and sealing means disposed in said internal ports of said base member to provide fluid-tight seals between internal ports in said base member and internal ports in said slidable member.

14. A linear hydraulic selector valve as defined in claim 13 wherein said sealing means includes shear-seals.

15. A linear hydraulic selector valve as defined in claim 11 wherein said connecting means includes a programmable jumper assembly.

16. A linear hydraulic selector valve as defined in claim 15 wherein said jumper assembly is fixed to said slidable

17. A linear hydraulic selector valve as defined in claim 11 wherein said inlet ports, said outlet ports and said vent ports terminate in said base member.

* * * * *